United States Patent [19]

Boissonnet et al.

[11] Patent Number: 4,776,812

[45] Date of Patent: Oct. 11, 1988

[54] SLITTED CONNECTION STRUCTURE FOR AN ELECTRIC WIRE

[75] Inventors: Alain Boissonnet, Ampuis; Jean-Paul Heng, Lyons; André Marmonier, Bron; Ariel Ruiz, Villeurbanne, all of France

[73] Assignee: CGEE Alsthom, Levallois-Perret, France

[21] Appl. No.: 41,276

[22] Filed: Apr. 22, 1987

[30] Foreign Application Priority Data

Apr. 28, 1986 [FR] France ..... 86 06125

[51] Int. Cl.[4] ..... H01R 4/24

[52] U.S. Cl. ..... 439/407; 439/408; 439/417

[58] Field of Search ..... 439/389, 391, 395, 406–408, 439/417

[56] References Cited

U.S. PATENT DOCUMENTS

| | | | |
|---|---|---|---|
| 3,183,472 | 5/1965 | Pawl | 439/408 |
| 3,910,672 | 10/1975 | Frantz | 339/97 P |
| 4,210,378 | 7/1980 | Baribeau | 339/97 R |
| 4,283,104 | 8/1981 | Pemberton | 439/395 |
| 4,286,836 | 9/1981 | Rumps | 439/406 |
| 4,344,664 | 8/1982 | Walkup | 439/406 |
| 4,466,682 | 8/1984 | Jusseau et al. | 339/97 R |

FOREIGN PATENT DOCUMENTS 2516711 5/1983 France .

*Primary Examiner*—J. Patrick McQuade

*Attorney, Agent, or Firm*—Sughrue, Mion, Zinn, Macpeak, and Seas

[57] ABSTRACT

The invention relates to a connection arrangement having a rectilinear insulation-piercing and wire-retaining slit, and to a tool endpiece for providing connection between wires (2) and such arrangements. The insulation-piercing and wire-retaining slit extends longitudinally along a profile-shaped portion (31, 32, 33) of a conductive part (3) having a U-shaped cross-section with the free ends of the U being folded towards each other and leaving a space therebetween corresponding to the width of the slit, said profile-shaped portion being intended to serve as a guide for the endpiece of the connection tool (6). The endpiece includes a core (60) whose shape is complementary to the shape of the cavity in the profile-shaped portion and which slides therealong. The endpiece slides parallel on either side of each of the folds (31) delimiting the slit in the profile-shaped portion, and it enters the housing via a hole (51) whose shape is complementary thereto, which hole, serves to guide the tool.

4 Claims, 3 Drawing Sheets

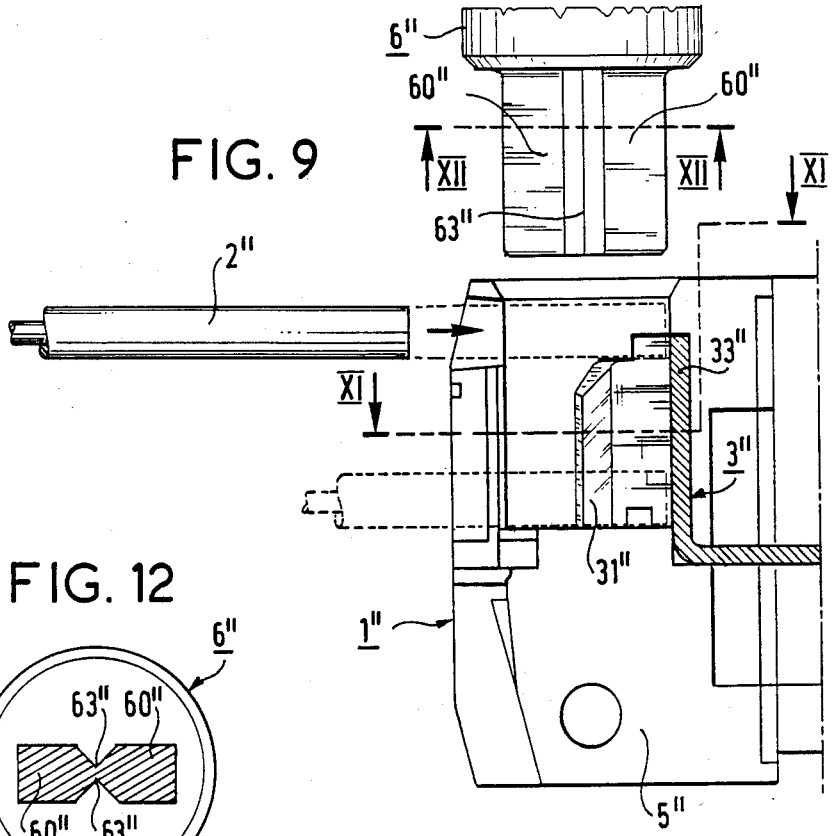
FIG. 9
FIG. 12
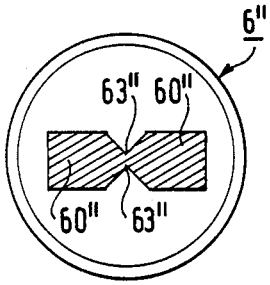
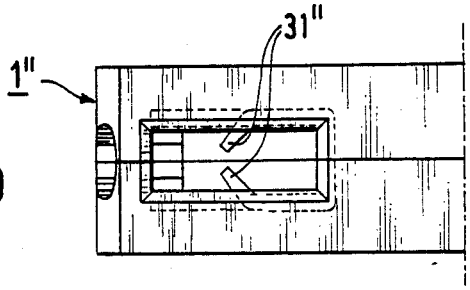
FIG. 10
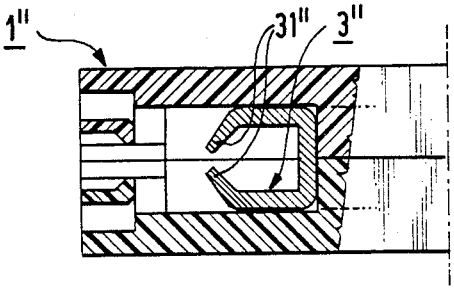
FIG. 11

SLITTED CONNECTION STRUCTURE FOR AN ELECTRIC WIRE

The present invention relates to a connector having an insualtion-piercing and core-retaining slit for one or more electric wires, and to a tool end piece for connecting wires in such arrangments.

BACKGROUND OF THE INVENTION

This slitted connection stucture is arranged to allow connection between electric wires and electric equipments by means of fixed or portable apparatuses giving greater connection uniformity than is provided by previously available manual tools of the thin shank or screwdriver blade type, while nevertheless retaining the possibility of using a simple manual tool if repairs need to be performed on installed equipment.

SUMMARY OF THE INVENTION

The present invention provides a slitted connection structure for at least one electric wire having a conductive core and aninsulating covering, the arrangement comprising:

at least one conductive connection part having a rectilinear core-retaining slit with an insulation-piercing inlet at at least one end;

an insulating housing in which said connection part is received, said housing beind provided with an opening extending level with said slit to enable wires to be admitted transversely over said inlet and for retaining the insulating coverings of wires whose cores are retained in said slit;

said structure including the improvement whereby said said conductive part which is shaped to include a portion having a cavity of uniform polygonal cross-section suitable for guiding an endpiece of an external tool in translation along said cavity, said slit extending longitudinally along said portion of uniform cross section plane margins such that when said tool is guided along said cavity it also runs along said slit, said tool being shaped to include portions which slide simultaneously on either side of and between said slit margins so as to force wires into said slit in a transverse position relative to said slit while being guided in said cavity, said insulating housing including a hole through which said tool is admitted into said housing, and said hole having edges suitable for guiding a tool endpiece towards said cavity in said conductive part.

The endpiece for a mechanical or manual tool required for connecting a wire in a connection arrangement in accordance with the invention may compries a rectilinear guide core whose cross section is suitable for enabling it to slide simultaneously along the internal cavity of said part while being guided thereby, and through the conductive connection slit by virtue of gooves in said core.

BRIEF DESCRIPTION OF THE DRAWINGS

Embodiments of the invention are described, by way of example with reference to the accompanying drawings, in which:

FIGS. 9 to 12 shown views similar to those of FIGS. 3, 5, 6, and 7 for a variant embodiment of the endpiece for the connection tool and the corresponding equipment.

MORE DETAILED DESCRIPTION

Figure 1:
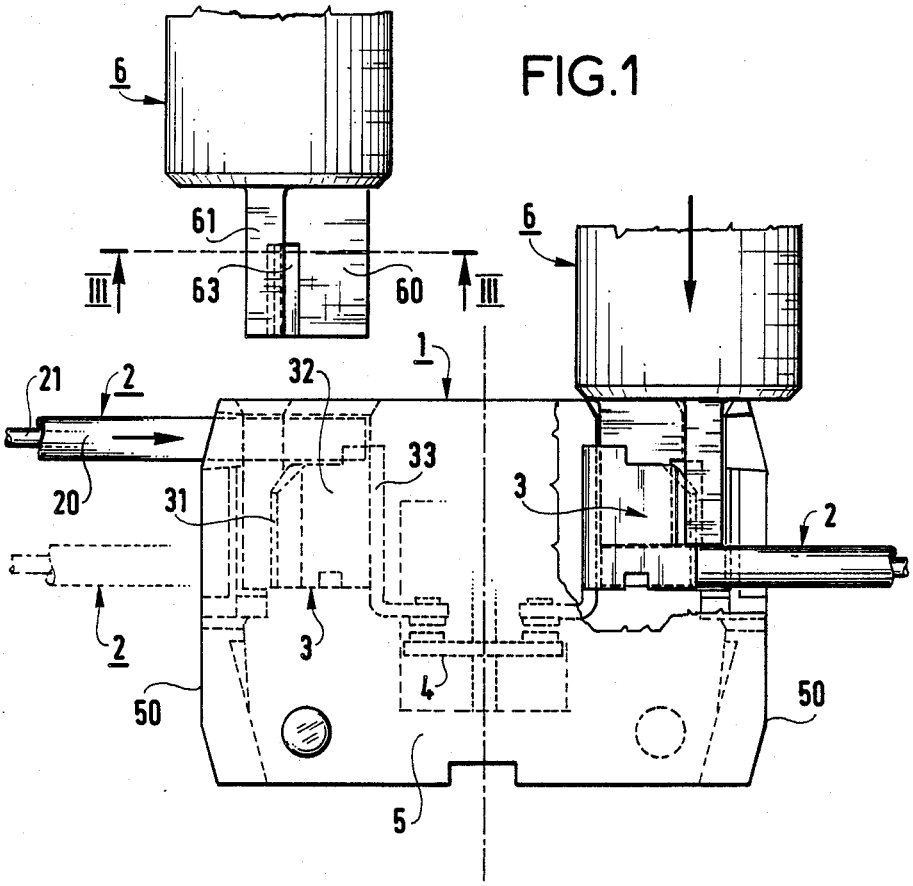
FIG. 1 shows an example of electrical equipment provided with two connection structures in accordance with the invention and associated with two connection tools in accordance with the invention for connecting elelctric wires, one of which is shown prior to insertion and the other during connection.

The slitted connection structure in accordance with the invention is intended to be integrated in electrical equipment 1 to provide parallel connection of one or more electric wires 2 to said equipment, which in the non-limiting example of FIG. 1 is provided with two slitted connection structures whose main internal components are drawn, for the most part, in dashed lines.

Each connection structure comprises a conductive connection part 3 suitable for receiving at least one, and preferably several electric wires 2 in parallel.

In the example shown, the two conductive parts 3 of the equipment 1 are suitable for being put into electrical connection by means of a conventional contactor member 4 which is not described in greater detail given that it has an optional and indirect relationship with the invention.

The conductive parts 3 are conventionally fixed in recessed provided for the purpose in the insulating housing 5 of the equipment 1 which may be constituted, for example, by an assembly of two complementary half-shells fixed together by ultrasonic welding after the internal members to be contained therein have been put into place.

The half-shells are assembled, for example, over a join plane which is the longitudinal mid-plane of the housing 5 which plane can be seen dividing FIG. 4, 6, 7 and 8.

Figure 2:
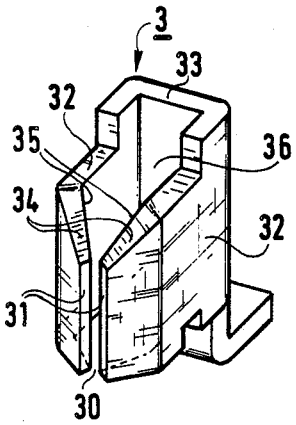
FIG. 2 shows an example of a conductive connection part for an arrangement in accordance with the invention.
Figure 3:
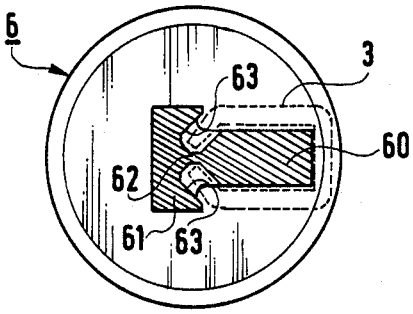
FIG. 3 is a cross-section on line III—III of FIG. 1, through an endpiece for a connection tool.

Each conductive part 3 (see FIG. 2) comprises a slit 30 for piercing the insulation and for clamping to the core of a wire, and in this case the slit is rectilinear as can be seen in FIGS. 2 and 3. This slit is provided longitudinally along a profiled portion of the part 3 which is obtained in this case, for example by stamping a flat blank to cut it to shape, and to fold it, and optionally to reduce its thickness locally.

Figure 7:
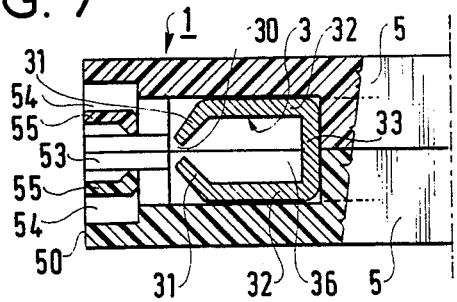

The profiled portion of the part 3 preferably has a hollow polygonal cross-section which in this case corresponds to a U-shape with the free ends thereof being sloping and folded towards each other as can be seen in FIGS. 2 and 7.

The resulting profiled portion comprises two end folds 31 corresponding to the free sloping and folded ends mentioned above, said two folds being on either side of the slit 30 delimited thereby, and optionally being gradually tapered towards said slit 30.

The two parallel walls 32 of the profiled portion of the conductive part 3, each containing one of the folds 31, serve to fix the part 3 in its recess together with the end wall 33 from which they both stem and to which they are both perpendicular. This fixing is provided by known means as already mentioned briefly above.

The insulation-piercing inlet 34 of the conductive part is provided at one end of the slit 30. It is also possible to provide profiled portions having an insulation-stripping slit with an insulation-piercing inlet at each end so as to provide a two-inlet connection arrangment.

In the example shown, the sole insulation-piercing inlet provided is obtained by symmetrical slopng cuts of the folds 31 at one of their ends, which end is the top end of the profiled portion as shown in FIGS. 1, 4, 5, and 8. This sloping cut provides a flared inlet. The subsequent folding of the fold 31 relative to the walls 32 which carry them serves to provide a top edge 35 which is suitable for nicking the insulation of wires 2 pushed into the inlet.

Figure 5:
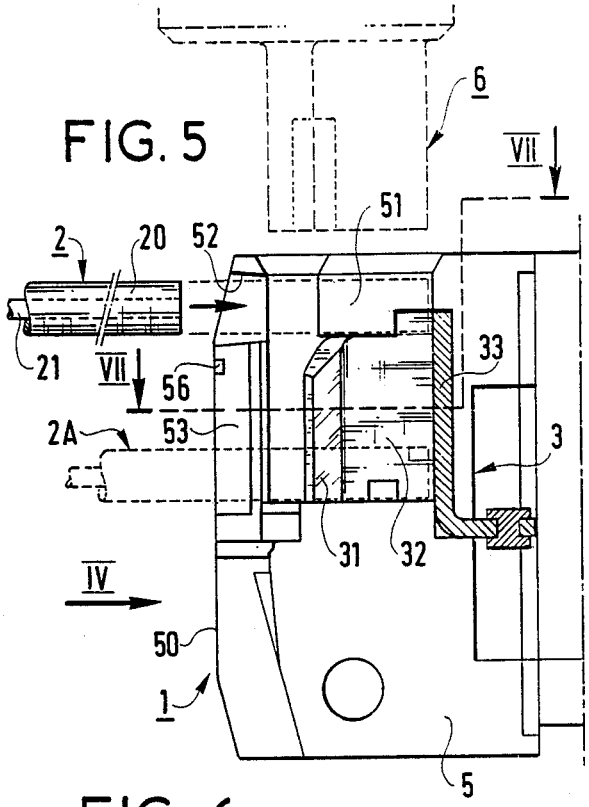
FIG. 5 is a half section on line V—V of the equipment shown in FIG. 4.
Figure 6:
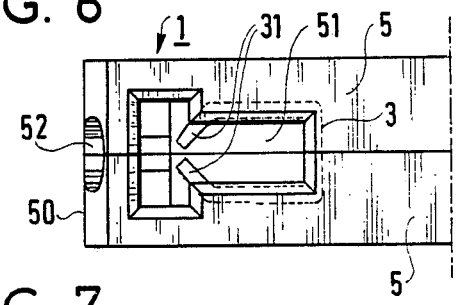
FIGS. 6 and 7 are a plan view and a section on line VII—VII of the portion of the equipment shown in FIG. 5.

The parallel walls 32, the end wall 33, and the folds 31 delimit a cavity 36 which is caused to open out to the outside via a hole 51 provided in the housing 5, and in this case through the top thereof (see FIGS. 5 and 6).

In this case, the cross-section or profile of the hole 51 is T-shaped, with the portion of the hole 51 that corresponds to the vertical bar of the T (which portion is horizontal in FIG. 6) having the same width as the cavity 36 and being disposed in the projection thereof.

The hole 51 which flares slightly at its edge giving access to the outside (i.e. its top edge in this case) is designed to enable the endpiece of an independent external connection tool to be inserted therein for the purpose of inserting electric wires into the slit 30 of the connection arrangement 3 and of any connection arrangement which is identical or compatible.

The endpiece of the tool 6 is provided, for this purpose, with, with a guide core 60 (see FIGS. 1, 2, and 3) which is rectilinear and whose cross-section is complementary in shape to the cross-section of the cavity 36 through which it is slid after being guided thereto by the portion of the hole 55 which is located in the extension of said cavity.

The guide core 60 has a longitudinal swelling 61 to one side thereof and is connected thereto by a rigid web 62. The web 62 is slightly narrower than the width of the slit 30 into which it is to be inserted when the endpiece is inserted into the housing 3, so that the guide core 30 then serves to position the web 62 properly relative to the slit 30.

The swelling 61 is suitable for sliding along the outside of the folds 31 as shown in FIG. 3 where the conductive part 3 is shown in dashed lines.

The core 60, its swelling 61, and the web 62 come to an end at the same level on the endpiece of the tool 6 so as to form a thrust zone for bieng applied agaisnt the covering of an electric wire to be connected.

In the embodiment chosen, the cross-section of the end piece is T-shaped, comprising two interconnected rectangular elements whose longitudinal axes are perpendicular, the core 60 corresponding to one of said two elements while the swelling 61 corresponds to the other, with the web being obtained by providing symmetrical sloping grooves on either side of the core and in the swelling. Each of the grooves 63 on either side of the web runs longitudinally along the endpiece from its thrust zone and enables said endpiece to be inserted in such a manner as to put the web 62 into the slit 30 with the folds 31 coming into the grooves 63.

In the selected embodiment, the hole 51 has a T-shaped cross-section which corresponds exactly to the cross-section of the endpiece so as to guide said endpiece, both towards the part 3 and while it slides along said part 3.

Naturally, the tool endpiece 6 which is shown in this case as being at the end of a cylindrical shank, could also be adapted to various different fixed or portable mechanical apparatuses for factory assembly or for assembly on site, and a manual tool could also be provided in which case a handle should be fitted to the opposite end of the shank.

Naturally, when using mechanical tools, the shank is driven mechanically (e.g. hydraulically or pneumatically) in a tool body which is preferably fixed in a temporary manner to the equipment 1 containing the appropriate connection arrangement or else to the arrangement itself, by any appropriate means.

The electric wire to be connected is admitted into the arrangement via an opening facing the slit 30 and provided in an outside wall 50 of the housing 5, said opening being intended to allow an electric wire 2 to be inserted over the insulation-piercing inlet 34 (see FIG. 4) and including a cylindrical orifice 52 through which the wire may be pushed axially until it comes into abutment agaisnt the end wall 33 of the conductive part 3.

The bottom portion of the orifice 52 is split so as to open out to the top of a rectangular slot 53 of the above opening and extending opposite the slit 30.

This rectilinear slot 53 is intended to retain the coverings of the connected wires, and is therefore slightly narrower than the diameter of the smallest expected covering, and similarly the slit 30 is slightly narrower than the diameter of the smallest expected wire core.

In the embodiment shown, two auxiliary slots 54 run along either side of the rectilinear slot 53 so as to enable regions of the housing to be deformed for clamping against wire coverings when the coverings are inserted without modifying the outside shape of the housing 5, which is particularly important when a plurality of housings are located side-by-side.

Figure 4:
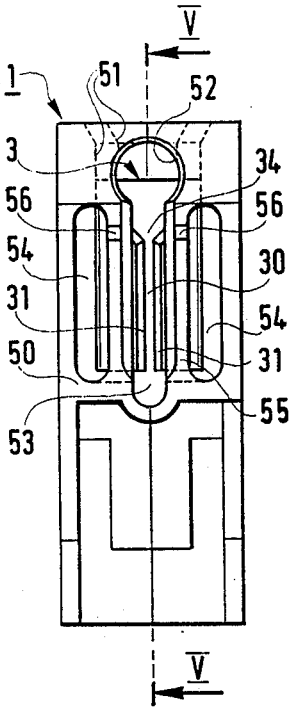
FIG. 4 is a side view of the equipment shown in FIG. 1.
Figure 8:
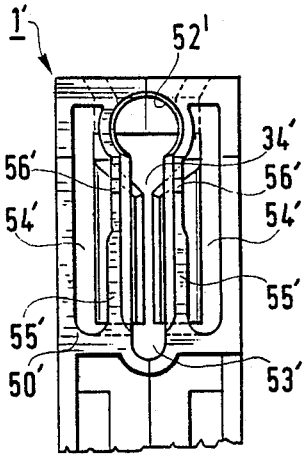
FIG. 8 shows a variant of the portion of the equipment shown in FIG. 4.

In a variant embodiment shown in FIG. 8, in which items which are identical or similar to those shown in FIG. 4 have the same numerical references applied thereto together with a prime symbol, the auxiliary slots 54' are separated from the rectilinear slot 53' by walls 55' which run from the wire insertion orifice 52' to below the level of the insulation-piercing inlet 34' and which are narrower than the following portions which run on from said level to the ends of the slots, thereby reducing the force required to move the covering of a wire into the rectilinear slot 53' while the insulation-piercing inlet 34' is slicing into said covering.

An electric wire 2 is connected by a process in which the non-stripped end of said wire is admitted axially through the orifice 52 provided for the purpose in the housing 5 (see FIG. 5). When the wire 2 comes into abutment aginst the end wall 33 of the conductive part 3, the endpiece of the tool 6 is inserted in the hole 51 which then guides it.

The end of the endpiece bears against the wire 2 which is pressed transversely towards the insulation-pierceing inlet of the conductive part 3, with the inlet guiding the covering 20 of the wire 2 so that the core 21 of the wire is inserted into the slit between the edges of the folds 31.

The length of the endpiece of the tool 6 is sufficient to enable a first wire 2 to be inserted down to the bottom of the slit, as shown at 2A in dashed lines in FIG. 5.

When a wire 2 is thrust transversely into a slit by the endpiece, the covering 20 of the wire is driven into the rectilinear slot 53 (or 53'), and when the wire has been pressed home, it is held in place by the slot 53 engaging the covering of the wire and by the slit 30 engaging the core of the wire.

In a variant (not shown), the endpiece of the tool 6 may be provided with a thrust member extending outside the housing 5 so as to thrust against the covering of the wire simultaneously on the outside and the inside of the housing when a wire is being connected.

After a wire has been fixed in place, the endpiece of the tool is removed from the housing 5, either completely when only one wire is to be connected, or optionally only partially so as to remain in the entrance to the hole 51 if one or more further wires are to be connected in the same slit of the conductive part 3.

FIGS. 8 to 11 show a variant embodiment provded to enable a tool to be used having an endpiece 6" whose crosssection is symmetrical as can be seen in FIG. 12, so as to avoid having to turn the tool through 180° when successively making connections to conductive parts mounted back-to-back as shown in FIG. 1 for the conductive parts 3.

The guide core 60" of the tool endpiece 6" shown in FIGS. 9 and 12 has symmetrical grooves which, like the core 60, serve to slide between the folds 30" delimiting the slit of a connection part such as 3".

The tool endpiece 6" is guided for inserting a wire 2" into a connection part such as 3" (see FIG. 9) by means of one or other of the two symmetrially-disposed half-cores 60" one of which is intended to engage in the hollow polygonal cross-section of the conductive part 3" and move along its insulation-piercing and wire-retaining slit, while the other slides over the outside of the slit but inside the insulating housing 5" containing the conductive part 3".

In the example shown in the tool endpiece is constituted by a generally rectangular body centered on the mid-longitudinal axis of the endpiece 6" with the grooves 63" being provided in the thickness thereof and on either side.

The equipment 1', which may be a terminal block, for example, includes at least one pair of slitted conductive parts 3", of which only one is shown, These parts are mounted backto-back and are interconnected, in this case by means of a common bar 4" and the assembly is received in an insulating housing 5" suitable for admitting both the electric wires for connection and the endpiece of the tool 6".

The connecting part 3" and the insulating housing 5" differ from those described above essentially by the reduced volume occupied by the connection parts and by the shape of the tool-admitting opening. In this case, the opening is in he form of a hole of rectangular section for guiding the endpiece of the tool into an accurate pre-determined position relative to the connection part 3" immediately under the hole.

A wire is connected in the same way as already described above.

We claim:

1. A slitted connection structure for at least one electric wire having a conductive core and an insulating covering, the structure comprising:

at least one conductive connection part having a rectilinear core-retaining slit with an insulation-piercing inlet at at least one end;

an insulating housing in which said connection part is received, said housing being provided with an opening extending level with said slit to enable wires to be admitted transversely over said inlet and for retaining the insulating coverings of wires whose cores are retained in said slit;

said structure including the improvement whereby said said conductive part is shaped to include a portion having a cavity of uniform polygonal cross-section suitable for guiding an endpiece of an external tool in translation along said cavity, said slit extending longitudinally along plane margins of said portion of uniform polygonal cross section such that when said tool is guided along said cavity it also runs along said slit, said tool being shaped to include portions which slide simultaneously on either side of and between said plane margins so as to force wires into said slit in a transverse porition relative to said slit while being guided in said cavity, said insulating housing including a hole through which said tool is admitted into said housing, and said hole having edges suitable for guiding a tool endpiece towards said cavity in said conductive part.

2. A connection structure according to claim 1, wherein the said portion uniform polygonal cross section in which the endpiece of the tool penetrates has a cross section which is U-shaped with the free ends of the U-shape sloping towards each other to constitute said plane margins and so as to provide,therebetween a space corresponding to the width of said slit and so as to accurately position a guide core of complementary shape on the tool endpiece when a wire is being thrust into the slit.

3. A connection structure according to claim 2, wherein said hole provided through the insulating housing for guiding the endpiece has a T-shaped cross section, with the portion of the hole corresponding to a vertical bar of the T-shaped cross section extending over said cavity and being of the same width so as to guide the tool endpiece during its penetration, with the portion of the hole corresponding to a cross bar of the T-shaped cross section providing access to the outside walls of said slit margins.

4. A connection structure according to claim 1, wherein said opening through said insulating housing through which wires are inserted and in whcih their insulating coverings are retained, includes a rectilinear slot for retaining said coverings level with said core-retaining slit and an orifice above said slot through which a wire is admitted over said insulation-piercing inlet of said slit, and is flanked by two auxiliary slots serving to enable zones of the housing between the slots to deform while connection is taking place without deforming the remainder of the housing, with a wall situated between each auxiliary slot and said rectilinear slot being narrower in that portion thereof which runs from the wire insertion orifice to below the inlet than in that portion thereof which continues towards bottoms of the slots in such a manner as to reduce the force required to displace the convering of a wire along the rectilinear slot while the wire-piercing inlet of the slit is slicing through said covering.

* * * * *